343-872 SR
10/5/76 XR 3,984,837

United States Patent [19]
Tatnall

[11] 3,984,837
[45] Oct. 5, 1976

[54] ROTATABLE AND TILTABLE RADOME WITH INDEPENDENT SCAN AND TILT ANTENNA

[75] Inventor: George J. Tatnall, Warminster, Pa.

[73] Assignee: The United States of America as represented by the Secretary of the Navy, Washington, D.C.

[22] Filed: Mar. 31, 1975

[21] Appl. No.: 563,914

[52] U.S. Cl. ..... 343/705; 343/765; 343/872
[51] Int. Cl.[2] ..... H01Q 1/28
[58] Field of Search ..... 343/705, 708, 765, 766

[56] References Cited
UNITED STATES PATENTS

| | | | |
|---|---|---|---|
| 2,745,098 | 5/1956 | Cady | 343/705 |
| 2,924,824 | 2/1960 | Lanctot et al. | 343/756.5 |
| 3,166,750 | 1/1965 | Ball | 343/705 |
| 3,215,391 | 11/1965 | Storm | 343/765 |
| 3,374,977 | 3/1968 | Moy Jr. | 343/765 |

*Primary Examiner*—Alfred E. Smith
*Assistant Examiner*—David K. Moore
*Attorney, Agent, or Firm*—R. S. Sciascia; Henry Hansen

[57] ABSTRACT

A low drag gyro stabilized radome for an aircraft. The radome is pivoted for roll and pitch by a universal joint between the radome and a pylon rigidly attached to the aircraft thereby enabling the radome, under gyro control, to remain horizontal to the ground during varying flight attitudes. An enclosed antenna is driven independently of the radome for tilt and sweep motion.

14 Claims, 6 Drawing Figures

10
12
14
16
18
20
22
24
26
28
30
32
34
36
38
40
42
44
46
48
50
54
56
57
58
60
62
-15°
+15°
20°
2
3
FWD

ROTATABLE AND TILTABLE RADOME WITH INDEPENDENT SCAN AND TILT ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to airborne antenna apparatus and particularly to a gyro stabilized radome which is pivoted for roll and pitch from a pylon rigidly attached to an aircraft and which encloses an antenna which is independently driven for tilt and sweep motion.

In operating an airborne radar, it is desirable that the antenna being utilized remain horizontal with reference to the ground regardless of the flight attitude of the aircraft. It is equally desirable that the aircraft radome which encloses the antenna be aerodynamically stabilized and present as small a frontal area and correspondingly low drag coefficient when the aircraft is in flight. One type of antenna stabilizing apparatus utilizes a radome which is rigidly mounted to the aircraft structure and which provides all necessary degrees of freedom to the enclosed antenna by a complex gimbal mechanism. Another type of antenna apparatus is a rotatable radome enclosing an antenna with the radome being rotatably mounted to one end of a pylon which is attached at its other end to the aircraft fuselage. The enclosed antenna is rigidly fixed within the radome and both radome and the antenna move in unison. The foregoing examples of antenna stabilizing apparatus generally utilize a large radome assembly which presents a relatively large frontal area during aircraft flight and which also requires complex gimbal stabilizing systems.

SUMMARY OF THE INVENTION

Accordingly, it is an object of the present invention to provide a gyro stabilized aircraft radome which presents only a relatively small amount of frontal area during aircraft flight. Another object of the invention is to provide a stabilized radome which is gyro controllable as to pitch and roll and which encloses an antenna which is independently actuated as to tilt and sweep. Yet another object of the present invention is to accomplish the aforementioned degrees of freedom in both the radome and enclosed antenna without the use of a complex gimbal system. Still another object is to provide a stabilized antenna apparatus that will maintain a constant tilt angle with respect to a horizontal ground reference regardless of aircraft flight attitude.

Briefly, these and other objects are accomplished by a low drag gyro stabilized radome mounted on an aircraft. The radome is pivoted for roll and pitch by a universal joint between the radome and a pylon rigidly attached to the aircraft thereby enabling the radome to remain horizontal to the ground during varying flight attitudes. The radome is rotated, respectively, by pitch and roll actuating rods which are positioned according to feedback signals from the aircraft gyro system. An enclosed antenna is driven independently for tilt and sweep motion interior to the radome.

For a better understanding of these and other aspects of the invention, reference may be made to the following detailed description taken in conjunction with the accompanying drawings.

DESCRIPTION OF THE PREFERRED EMBODIMENT

Figure 1:
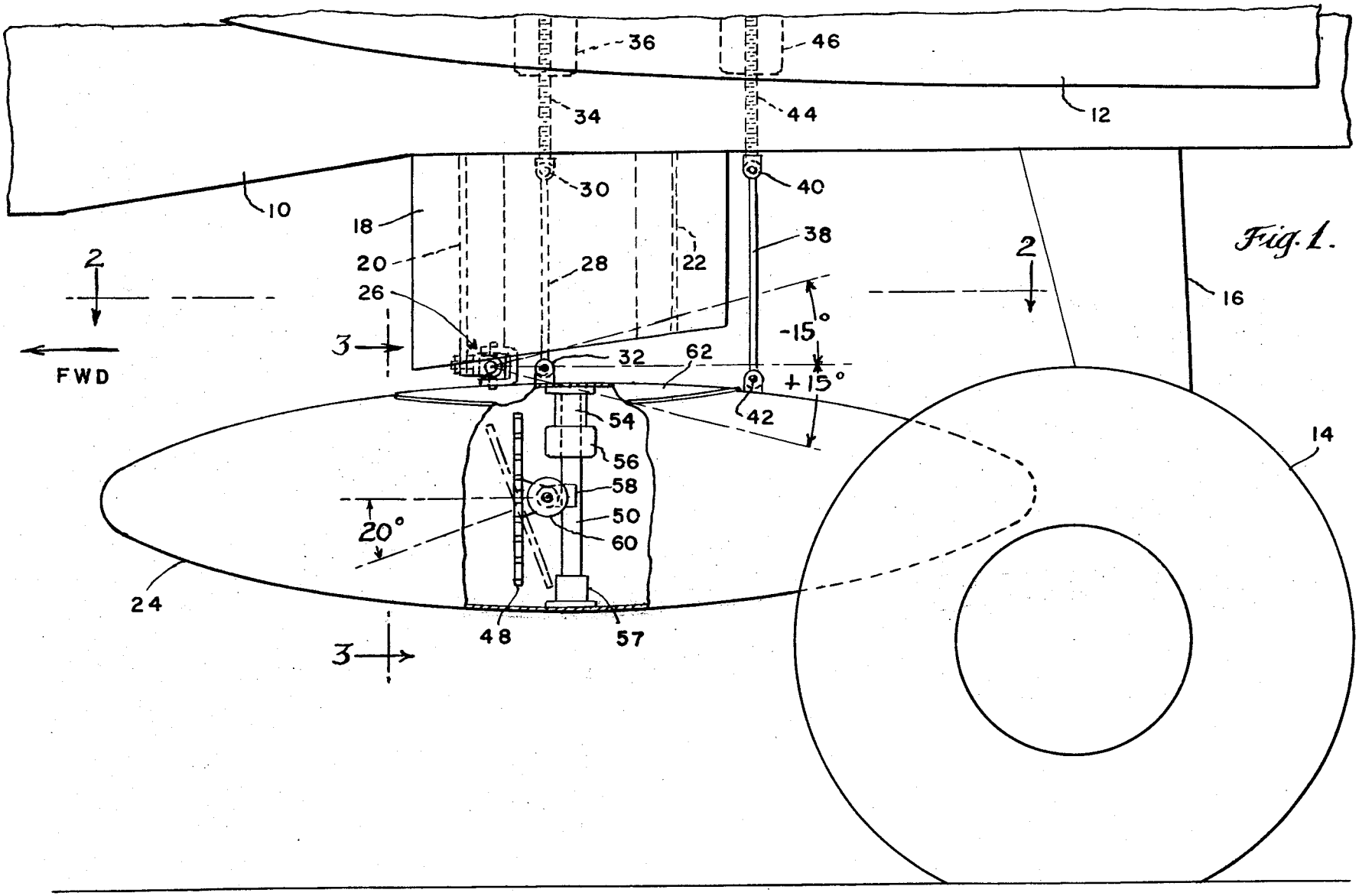
FIG. 1 is a side elevational view of a gyro stabilized radome constructed in accordance with the present invention.

Referring now to FIG. 1, there is shown a side elevational view of a fragmentary portion of the bottom skin of an aircraft fuselage 10 and a portion of an attached wing 12. A landing wheel 14 is supported from the fuselage 10 by a strut 16. The outer skin of a pylon 18 is rigidly attached underneath the fuselage 10 and encloses a forward channel member 20 and a rear channel member 22 which both extend vertically downward from the bottom of the fuselage 10 towards a tiltable circular radome 24. The radome 24 is an ellipsoid and is shown in the side view with a horizontal major axis (not shown) formed by the diameter of the radome and a vertical minor axis (not shown) which is formed at the center of the radome. The radome 24 is rotatably supported by means of a universal joint 26 which is connected at one end to the top portion of the radome 24 and at the other end is connected to the web of the forward channel member 20. A roll actuating rod 28 is attached at the ends thereof to ball joints 30, 32 which are secured, respectively, to a screw 34 and to a top portion of the radome 24. The screw 34 extends from inside the fuselage 10 and external to the pylon 18 and is actuated by a roll motor 36 contained within the fuselage. A pitch actuating rod 38 is secured at the ends thereof to a pair of ball joints 40, 42 which are connected, respectively, to a screw 44 and to the top surface of the radome 24. The screw 44 extends outwardly from within the fuselage 10 and is activated by a pitch motor 46 contained within the fuselage. The radome 24 encloses an antenna 48 which is arranged to sweep about a central axle 50 which is mounted vertically at the center of the radome 24 about the minor axis and which is supported by an upper bearing 54 in contact with the inside top surface of the radome 24, and by a lower bearing 57 which is secured to the inside bottom surface of the radome 24. A motor 56 is coaxially mounted about the axle 50 and causes the axle 50 and the attached antenna 48 to rotate in a 360° sweep about the axle. A bracket 58 is attached at one end to the centerpoint along the length of the axle 50 and at the other end supports a tilt motor 60 which drivingly engages the antenna 48 and causes the antenna to tilt in a direction which is referenced normal to the longitudinal axis of the axle 50. The radome 24 is made from conventional material which provides rigidity and strength and which is transparent to microwave energy. A top cap 62 is provided at the top surface of the radome and covers a circular area to provide extra strength and rigidity for the attachment of the universal joint 26. The cap 62 may be comprised, for example, of a metallic material or, simply, an additional layer of the conventional material used in the manufacture of the rest of the radome 24.

Figure 2:
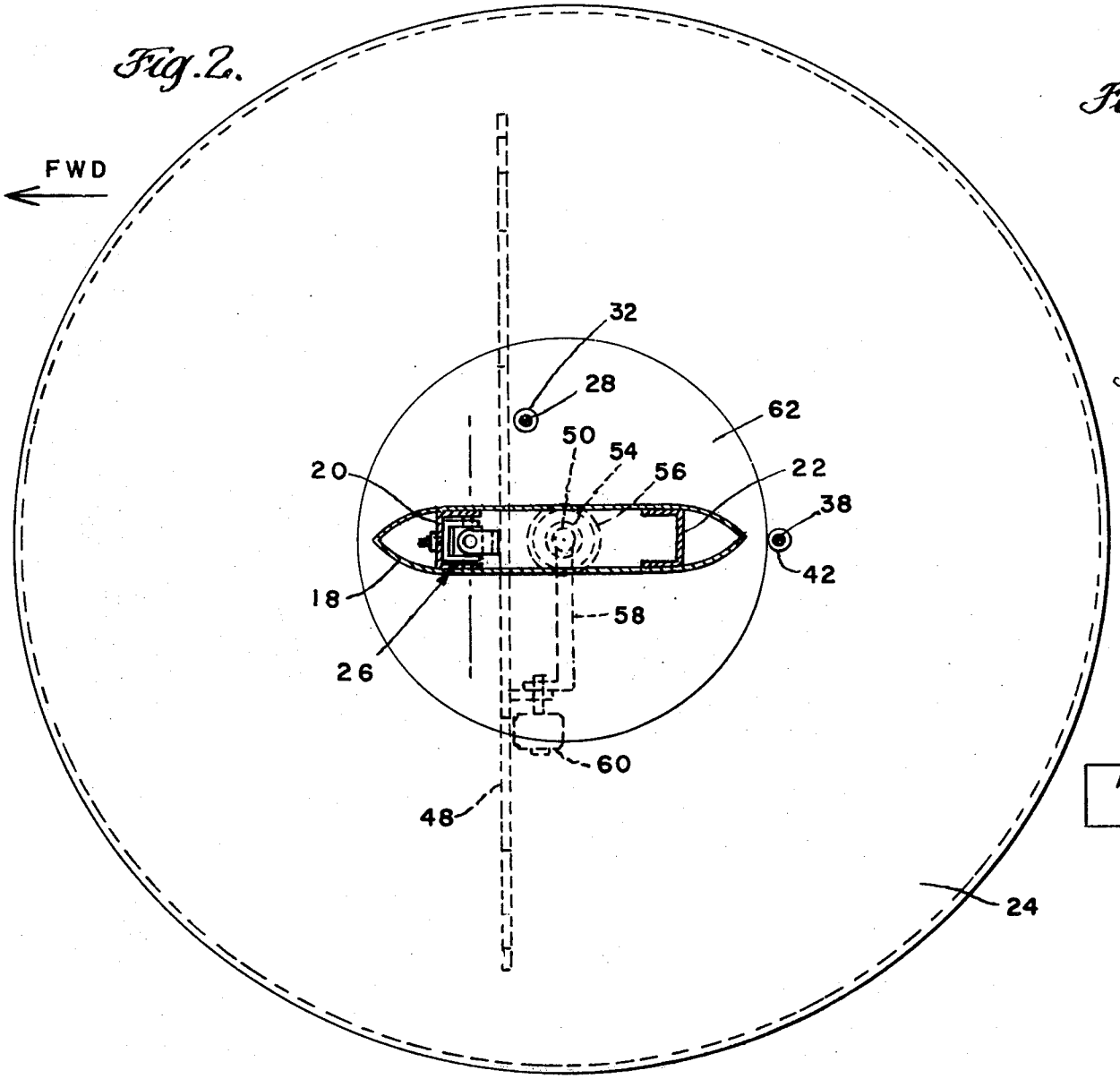
FIG. 2 is a plan view section of the radome taken on the line 2—2 of FIG. 1.

Referring now to FIG. 2, there is shown a top plan section of the radome 24 and associated structure taken on the line 2—2 shown in FIG. 1. The top cap 62 is now more clearly shown centered about the top surface of the circular radome 24. The end of the axle 50 is shown centered within the radome 24 and terminating in the upper bearing 54 below which is mounted the sweep motor 56. Also more clearly shown is the bracket 58 extending radially from the axle 50 and supporting the tilt motor 60 which is drivingly attached to the antenna 48. The pylon 18 is shown enclosing the rear channel member 22, the front channel member 20, and the universal joint 26 which is secured to the front web of the member 20. The lower ball joint 32 which engages the roll actuating rod 28 is shown placed on the cap 62 to one side and forward of the axle 50. The lower ball joint 42 which engages the pitch actuating rod 38 is shown placed at the outer perimeter of the cap 62 rearward of the axle 50 and is positioned along the longitudinal axis of the pylon 18.

Figure 3:
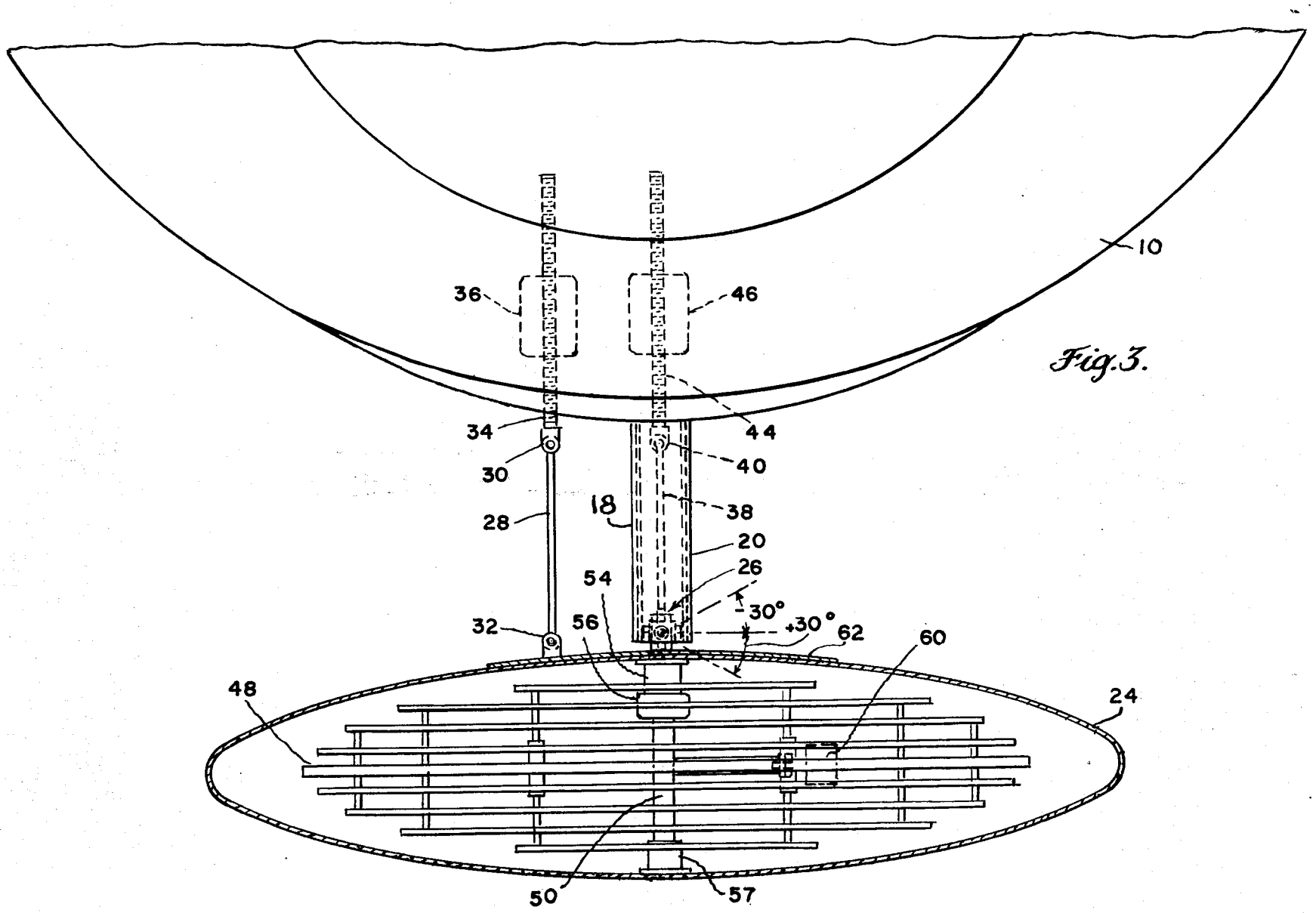
FIG. 3 is a front view of the radome and associated apparatus taken in the direction indicated by the arrows 3—3 in FIG. 1 and with the radome shown in section.

Referring now to FIG. 3, there is shown a front view of the radome 24 taken in the direction indicated by the arrows 3—3 shown in FIG. 1, and with the radome shown in section. As can now be more clearly seen, the radome 24 is sized and shaped according to the configuration of the antenna 48 which, in this sectional view, occupies most of the cross-sectional area shown within the radome 24. The radome is circular as shown in the plan view of FIG. 2 in order to enable a full 360° sweep of the antenna 48. The sweep motor 56 is shown located to the rear of the antenna 48 which is ultimately supported within the radome 24 by the upper and lower bearings 54, 57, respectively. The roll motor 36 is shown positioned to the left of the pitch motor 46 within the fuselage 10. The pylon 18 is rigidly attached to the fuselage 10 and extends downward toward the radome with the enclosed front channel member 20 supporting the universal joint 26 which is connected at its bottommost end to the cap 62.

Figure 4:
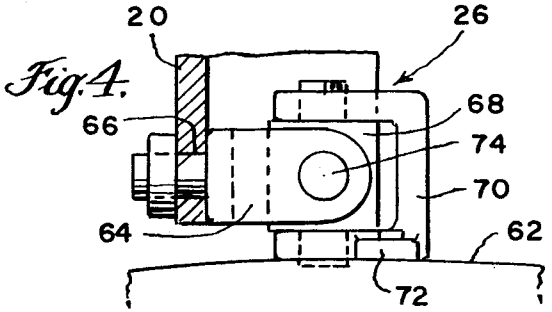
FIG. 4 is an enlarged detailed view of the universal joint as shown in FIG. 1.

Referring now to FIG. 4, there is shown an enlarged detailed elevational view of the universal joint 26 with the orientation as shown in FIG. 1. The universal joint 26 comprises a first yoke 64 rotatably secured at a first pivot axis 66 in the forward channel member 20, a central swivel block 68 which engages the yoke 64 at a second pivot axis 74, and a second yoke 70 secured at a flange 72 to the radome cap 62. Thus pivot axis 66 forms the roll axis and pivot axis 74 forms the pitch axis, respectively, for the radome 24.

Figure 5:
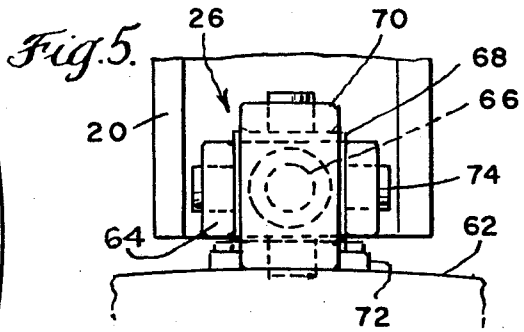
FIG. 5 is a front view of the universal joint shown in FIG. 4 and as viewed from the right in FIG. 4.

Referring now to FIG. 5, there is shown a front view of the universal device 26 shown in FIG. 4 and as viewed from the right in FIG. 4. More clearly shown is the swivel block 68 secured between the yokes 64, 70 and having four orthogonal axes extending outwardly from the swivel and engaging with the respective yokes. The horizontal pair of pivot axes 74 shown extending from the swivel 68 form the pitch axis for the radome.

Figure 6:
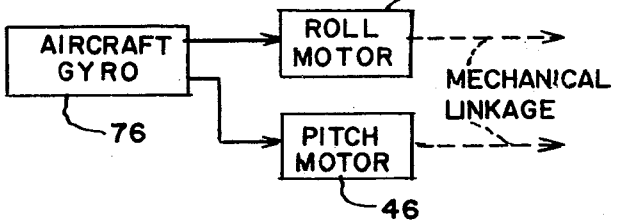
FIG. 6 is a schematic block diagram of an aircraft gyro control system for rotating the radome shown in FIG. 1.

Referring now to FIG. 6, there is shown a schematic block diagram of an aircraft gyro control system for rotating the radome 24 shown in FIG. 1. An aircraft gyro 76, which is conventionally located within the aircraft, senses the flight attitude of the aircraft in any well known manner and provides dual output signals representative, respectively, of the pitch and roll attitudes of the aircraft and which signals are respectively received by the roll motor 36 and the pitch motor 46 shown in FIG. 1. Mechanical linkage outputs from each of the motors 36, 46 are then connected to the respective screws and actuating rods shown in FIG. 1 to thereby rotate the radome 24.

Referring now to FIGS. 1–6, the operation of the invention will now be explained. Assuming that the aircraft is initially "on station" and is flying horizontal with reference to the ground, the aircraft gyro 76 shown in FIG. 6 does not normally produce a roll or pitch output signal to the respective motors 36, 46 inasmuch as the horizontal plane of the radome 24 is parallel with the plane of the aircraft formed by the wings and fuselage. However, should the aircraft go into an ascending or descending attitude, the gyro 76 produces an output signal indicative of the corresponding change in pitch which is received by the pitch motor 46 within the aircraft fuselage 10 and which accordingly actuates the screw 44 and the actuating rod 38 to cause the radome 24 to assume a pitch attitude which continues to be in horizontal reference with the ground. That is, for example, if the aircraft is ascending at a 10° angle, the gyro 76 senses the change and provides a correcting signal to the motor 46 which causes the actuating rod 38 shown in FIG. 1 to retract upwardly towards the fuselage 10 and thereby draw the radome 24 in a negative angular direction 10° in order to maintain a horizontal reference with the ground. Similarly, should the aircraft go into a 15° roll towards the right, the gyro 76 senses this change and provides a corrective output signal to the roll motor 36 which in turn actuates the roll actuating rod 28 so as to retract the rod 28 towards the fuselage 10 in a positive angular displacement as shown in FIG. 3 of 15°. The gyro 76 is also capable of simultaneously producing output signals which are indicative of a concurrent change in both aircraft roll and pitch and accordingly the motors 36, 46 can also act in combination to produce the desired result of maintaining the radome 46 in a horizontal attitude with respect to ground during various flight attitudes of aircraft operation. By stabilizing the radome with respect to the horizontal ground reference, the enclosed antenna is permitted to sweep with a tilt angle that is maintained constant with respect to the ground regardless of aircraft flight attitude. The gyro 76 in conjunction with the motors 36, 46 may also be utilized to correct the trim of the radome 24 during flight and to thereby minimize the corresponding drag coefficient or effective surface area which the radome 24 presents. Interior to the radome 24 and independently driven is the antenna 48 which is caused to continuously sweep about the axle 50 in successive 360° revolutions by the sweep motor 56. Obviously, the antenna may also be programmed to sweep only over predetermined portions of a full 360° scan, if desired. Concurrent with the sweeping operation produced by the motor 56 is a tilt motion either up or down produced by the tilt motor 60 mounted between the antenna 48 and the bracket 58 which is secured to the axle 50. The activating switches and controls for sweep and tilt motion of the antenna are placed in any convenient location such as, for example, on the operating control console of a radar display placed within the aircraft.

While the pylon 18 and universal joint 26 have been shown in FIG. 1 exterior to the radome 24, it is also contemplated that in light of the foregoing teachings of the present invention that the radome, pylon, and actuating rod assemblies may be otherwise configured so as to provide still further improvements in lessening drag coefficients and frontal areas by, for example, providing a hollowed out portion at the top surface of the radome 24 and placing the universal joint 26 therein with the pylon and its attached faring extending down into the hollowed portion to provide continuity in air surface area and thereby minimize drag coefficient. In some instances the pylon extension may also be eliminated with only a pivot joint placed between the aircraft and the radome. The use of a pylon, however, serves to position the pivoted radome at some predetermined distance from the aircraft and can serve to lessen the drag coefficient in this configuration. Moreoever, the actuating rod 38 may also be incorporated interior to the pylon 18 and towards its rearmost surface. The displacement angles shown in the present embodiment of ±15° for pitch, ±30° for roll, and a tilt angle of 20° are intended to be shown by way of example only as it will be obvious to those skilled in the art that other angular displacements can be incorporated into the present invention with allowances made in the shape and size of the pylon, radome, and actuating assemblies to effectuate the required displacements. The radome shown within the present embodiment is an ellipsoid but may also be bi-convex, pancake-shaped or otherwise configured for smooth air flow and freedom of movement for the enclosed antenna. The size of the radome is determined by the size of the antenna and it is intended that the radome be selectively sized to provide only the minimum amount of internal clearance for antenna sweep and tilt motion.

Thus it may be seen that it has been provided a novel low drag gyro stabilized radome which is pivoted for roll and pitch by a universal joint and which encloses an antenna which is driven independently of the radome for tilt and sweep motion.

Obviously many modifications and variations of the invention are possible in light of the above teachings. For example, the radome may be rotated for pitch control by a pair of differentially actuated rods suitably positioned on the top surface of the radome instead of the single actuating rod as shown in the present embodiment or additional rotatable antennae may be added to the interior radome structure. Moreover, the radome and associated actuating structure may be placed in any convenient position on the aircraft such as the top of the fuselage. It is therefore to be understood that with the scope of the appended claims the invention may be practiced otherwise than as specifically described.

What is claimed is:

1. An antenna apparatus for an aircraft, comprising:

an antenna rotatable within preselected angles about a scanning axis and a tilt axis perpendicular to said scanning axis;

a radome formed to be pivotally connected to the aircraft, said radome enclosing said antenna with said axes fixed relative to said radome and having a minimum internal clearance for permitting scan and tilt of said antenna;

means connected to said antenna for effecting displacement thereof in tilt and scan directions about the respective antenna axes independent of the attitude of said radome; and control means formed to be connected to the aircraft and operatively connected to said radome for effecting displacement thereof about a pitch axis and a roll axis perpendicular to said pitch axis.

2. Antenna apparatus according to claim 1 wherein said antenna displacement means further comprises:

axle means positioned along the scanning axis of said antenna and rotatably secured at the ends thereof to the interior surface of said radome;

first rotating means drivingly connected to said axle means for effecting the rotation of said antenna about said scanning axis; and second rotating means drivingly secured between said antenna and a point intermediate the ends of said axle means for tilting said antenna about said tilt axis.

3. Antenna apparatus according to claim 2 wherein said axle means further comprises:

an axle positioned along said scanning axis;

a first bearing rotatably secured between one end of said axle and a first portion of said radome interior surface; and a second bearing rotatably secured between the other end of said axle and a second portion of said radome interior surface.

4. Antenna apparatus according to claim 2 wherein said control means further comprises:

gyro means for sensing changes in roll and pitch of the aircraft and for providing roll and pitch output signals indicative thereof;

roll displacement means connected to receive said gyro means roll output signal and formed to be secured between the aircraft and said radome to effect roll displacement of said radome according to said roll output signal; and pitch displacement means connected to receive said gyro means pitch output signal and formed to be secured between the aircraft and said radome to effect pitch displacement of said radome according to said pitch output signal.

5. Antenna apparatus according to claim 4 wherein said roll displacement means further comprises:

first motor means connected to receive said gyro means roll output signal for moving an output shaft a predetermined distance according to said output signal; and a first actuating rod assembly rotatably engaged at one end to said first motor means output shaft and rotatably engaged at the other end to said radome to effect roll displacement thereof.

6. Antenna apparatus according to claim 4 wherein said pitch displacement means further comprises:

second motor means connected to receive said gyro means pitch output signal for moving an output shaft a predetermined distance according to said output signal; and a second actuating rod assembly rotatably engaged at one end to said second motor means output shaft and rotatably engaged at the other end to said radome for effecting pitch displacement thereof.

7. Antenna apparatus according to claim 4 wherein said radome is an ellipsoid.

8. An antenna apparatus for an aircraft, comprising:

pivot means formed to be connected to the aircraft;

an antenna rotatable within preselected angles about a scanning axis and a tilt axis perpendicular to said scanning axis;

a radome rotatably connected to said pivot means, said radome enclosing said antenna with said axes fixed relative to said radome and having a minimum internal clearance for permitting scan and tilt of said antenna;

means connected to said antenna for effecting displacement thereof in tilt and scan directions about the respective antenna axes independent of the attitude of said radome; and control means formed to be connected to the aircraft and operatively connected to said radome for effecting displacement thereof about a pitch axis and a roll axis perpendicular to said pitch axis.

9. Antenna apparatus according to claim 8 wherein said antenna displacement means further comprises:

axle means positioned along the scanning axis of said antenna and rotatably secured at the ends thereof to the interior surface of said radome;

first rotating means drivingly connected to said axle means for effecting the rotation of said antenna about said scanning axis; and second rotating means drivingly secured between said antenna and a point intermediate the ends of said axle means for tilting said antenna about said tilt axis.

10. Antenna apparatus according to claim 9 wherein said axle means further comprises:

an axle positioned along said scanning axis;

a first bearing rotatably secured between one end of said axle and a first portion of said radome interior surface; and a second bearing rotatably secured between the other end of said axle and a second portion of said radome interior surface.

11. Antenna apparatus according to claim 9 wherein said control means further comprises:

gyro means for sensing changes in roll and pitch of the aircraft and for providing roll and pitch output signals indicative thereof;

roll displacement means connected to receive said gyro means roll output signal and formed to be secured between the aircraft and said radome to effect roll displacement of said radome according to said roll output signal; and pitch displacement means connected to receive said gyro means pitch output signal and formed to be secured between the aircraft and said radome to effect pitch displacement of said radome according to said pitch output signal.

12. Antenna apparatus according to claim 11 wherein said roll displacement means further comprises:

first motor means connected to receive said gyro means roll output signal for moving an output shaft a predetermined distance according to said output signal; and a first actuating rod assembly rotatably engaged at one end to said first motor means output shaft and rotatably engaged at the other end to said radome to effect roll displacement thereof.

13. Antenna apparatus according to claim 11 wherein said pitch displacement means further comprises:

second motor means connected to receive said gyro means pitch output signal for moving an output shaft a predetermined distance according to said output signal; and a second actuating rod assembly rotatably engaged at one end to said second motor means output shaft and rotatably engaged at the other end to said radome for effecting pitch displacement thereof.

14. Antenna apparatus according to claim 11 wherein said radome is an ellipsoid.

* * * * *